US009828224B1

(12) United States Patent
Hamilton

(10) Patent No.: US 9,828,224 B1
(45) Date of Patent: Nov. 28, 2017

(54) APPARATUS AND SYSTEM TO LIFT AND/OR RELOCATE AN OBJECT

(75) Inventor: Martin Hamilton, Tacoma, WA (US)

(73) Assignee: The Boeing Company, Chicago, IL (US)

( * ) Notice: Subject to any disclaimer, the term of this patent is extended or adjusted under 35 U.S.C. 154(b) by 767 days.

(21) Appl. No.: 13/041,893

(22) Filed: Mar. 7, 2011

(51) Int. Cl.
*B66F 9/12* (2006.01)

(52) U.S. Cl.
CPC ..... *B66F 9/12* (2013.01)

(58) Field of Classification Search
CPC .... B66C 1/62; B66C 1/00; B66C 1/10; B66C 1/66; B66C 1/22; B66C 1/485; B66C 1/54; B66C 1/663; B66C 1/101; B66C 1/12; B66C 1/32; B66C 1/64; B66C 1/28; B66C 1/105; B66C 1/24; B66C 1/68; B60B 29/00; B66F 9/18; B66F 9/185; B66F 9/12; B66F 9/06; B66F 9/061; B66F 9/186; B66F 9/07504; B66F 9/183; B66F 9/184; B66F 9/187; B66F 9/188; B66F 9/19; B65G 61/00; B65G 47/90; B55F 9/12; B25J 15/0253; B25J 15/10; B25J 15/028; B25J 15/026; B22C 21/00; B62B 1/14; B62B 1/12; B60P 1/5433; F16M 11/041; B60C 25/132; B60C 25/135; B60C 25/0527; B60C 25/005
USPC ..... 294/81.1, 68.3, 90, 119.1, 67.3, 67.33, 294/607, 207, 81.21, 81.54, 81.62; 414/426, 619, 607, 626, 490, 547; 248/316.8; 157/1.26, 1.28
See application file for complete search history.

(56) References Cited

U.S. PATENT DOCUMENTS

| | | | | | |
|---|---|---|---|---|---|
| 2,314,792 | A | * | 3/1943 | Korner | B66C 1/125 294/67.22 |
| 2,362,991 | A | * | 11/1944 | Dahl | B64F 1/22 180/14.1 |
| 2,422,848 | A | | 6/1947 | Peters | |
| 2,719,643 | A | * | 10/1955 | McDonald | 414/607 |
| 2,794,669 | A | * | 6/1957 | Schardinger | 294/97 |
| 2,951,725 | A | * | 9/1960 | St. Jean | 294/97 |
| 3,195,751 | A | * | 7/1965 | Meyers | B66F 9/061 294/195 |
| 3,409,156 | A | * | 11/1968 | Mills | 414/607 |
| 3,500,891 | A | * | 3/1970 | Collins | B60C 25/14 157/1.2 |
| 3,825,869 | A | | 7/1974 | Loomis | |
| 3,850,221 | A | * | 11/1974 | Zrostlik et al. | 157/1.33 |
| 3,930,585 | A | * | 1/1976 | Lynch | 414/607 |
| 3,970,342 | A | * | 7/1976 | Cotton | 294/86.4 |
| 4,073,175 | A | * | 2/1978 | Seamon | 72/325 |
| 4,136,903 | A | | 1/1979 | Roethler | |
| 4,256,429 | A | * | 3/1981 | Dwyer | 414/626 |
| 4,290,729 | A | * | 9/1981 | Cary | 414/607 |

(Continued)

FOREIGN PATENT DOCUMENTS

| | | | | |
|---|---|---|---|---|
| DE | 202005007064 U1 | * | 9/2005 | B66F 9/182 |

*Primary Examiner* — Glenn Myers
(74) *Attorney, Agent, or Firm* — Christopher J. Knors; Moore & Van Allen PLLC

(57) ABSTRACT

An apparatus, method, and a system for the lifting and/or relocation of a large and/or heavy object are disclosed. The present disclosure relates to an apparatus and a system comprising a pair of engagement members each independently configurable to external equipment, and a pair of oppositely facing structural members, each coupled to one of said pair of engagement members.

11 Claims, 11 Drawing Sheets

(56) References Cited

U.S. PATENT DOCUMENTS 4,454,683 A * 6/1984 Schauer et al. ..... 47/76
4,600,354 A * 7/1986 Niewald ..... B66F 19/00 414/607
4,737,066 A * 4/1988 Allison, Jr. ..... 414/563
4,911,605 A * 3/1990 Berg ..... B66F 9/187 294/87.1
4,941,798 A * 7/1990 Meier ..... 414/619
5,088,577 A * 2/1992 Pierce ..... E04G 5/00 182/179.1
5,161,934 A * 11/1992 Richardson ..... 414/621
5,226,465 A * 7/1993 Schon et al. ..... 157/1.28
5,366,339 A * 11/1994 Gould ..... 414/607
5,466,026 A 11/1995 Steiner
5,476,300 A * 12/1995 Dodge ..... 294/81.21
5,486,083 A * 1/1996 Thompson ..... B66F 9/185 294/67.31
5,496,147 A * 3/1996 Taube ..... B66F 9/19 294/90
5,560,451 A * 10/1996 Hincks ..... B66F 9/12 187/222
5,618,159 A * 4/1997 Wilson ..... B66F 9/12 187/237
5,688,010 A * 11/1997 Moyer ..... 294/67.2
5,716,183 A * 2/1998 Gibson et al. ..... 414/451
5,826,893 A * 10/1998 Snoeyenbos ..... 280/43
5,984,614 A * 11/1999 Weber ..... 414/498
6,125,904 A * 10/2000 Kane et al. ..... 157/1.24
6,287,073 B1 * 9/2001 Lindgren ..... B66F 9/12 414/544
6,386,609 B1 * 5/2002 Govzman ..... B25J 15/0253 294/119.1
6,615,649 B1 * 9/2003 Kokubu et al. ..... 73/146
6,669,089 B2 * 12/2003 Cybulski ..... B65D 19/00 235/383
7,214,025 B2 * 5/2007 Rudolph ..... B66F 9/18 186/63
8,079,799 B2 * 12/2011 Rathbun et al. ..... 414/626
8,740,540 B2 * 6/2014 Daraie ..... A01D 87/127 414/785
2001/0038094 A1 11/2001 Lundy, Sr. et al.
2004/0100111 A1 * 5/2004 Stinis ..... 294/81.21
2006/0182587 A1 * 8/2006 Hrkal ..... 414/626
2007/0057476 A1 * 3/2007 Decky ..... 280/47.28
2009/0295179 A1 * 12/2009 Michaels ..... 294/97
2010/0166531 A1 * 7/2010 Bauer et al. ..... 414/429
2010/0272547 A1 * 10/2010 Cottone et al. ..... 414/426
2011/0038696 A1 * 2/2011 Ummel, Jr. ..... 414/408
2011/0048650 A1 * 3/2011 Lawson ..... B25J 15/0028 157/16
2011/0170999 A1 * 7/2011 Hailston ..... B66F 9/12 414/607
2012/0153654 A1 * 6/2012 Cole ..... 294/119.1

* cited by examiner

APPARATUS AND SYSTEM TO LIFT AND/OR RELOCATE AN OBJECT

TECHNICAL FIELD

This disclosure relates generally to an apparatus and a system for the lifting and/or relocation of an object. Specifically, the disclosure relates to an apparatus and system to vertically and/or horizontally relocate large and/or heavy objects such as a tire, barrel, or the like.

BACKGROUND

The movement of large and/or heavy objects from one place to another can be a time-consuming and potentially hazardous endeavor. For example, large tires range in diameter as well as weight. Not only does such variation in tire size and weight present safety concerns, such objects complicate the development of equipment suitable for this task. In facilities where a large number of aerospace vehicle tires may be present or may be routed, it may not be economically or physically possible to accommodate a large, expensive device designed only for the transportation of and/or lifting of large aerospace vehicle tires, such as a crane or the like. While a number of motorized vehicles may be present at these facilities, such vehicles are not generally suited to safely accommodate the vertical and/or horizontal movement of large and/or heavy objects such as tires that is necessary for routine operations.

While a forklift alone can be used to vertically/horizontally relocate large and/or heavy objects, such as an aerospace vehicle tire from a rest state, the object can be rendered unstable on the forks, which can pose concerns to person(s) in proximity to the object during its relocation. It is also undesirable to use a forklift to vertically displace some objects, as the forks may cause or introduce structural or cosmetic damage to the object. If a pallet is used to lift the object by forklift, at least a portion of the underside of the object can be obscured, preventing visual inspection and requiring the object to be "flipped" or otherwise further manipulated in order to visually observe the entirety of the object, resulting in additional labor and/or time.

SUMMARY

Thus, it is therefore at least one object of this present disclosure to provide an apparatus, method, and a system for use in the lifting of a large and/or heavy object. The presently disclosed apparatus can prevent or eliminate injuries in undertaking such a task, significantly decrease the time taken to complete the task, and reduce man hours by eliminating a second person as a spotter and/or helper. The present disclosure provides an apparatus for use in the lifting of large and/or heavy objects that is readily configurable to a wide variety of different sized objects, such as tires, pipes, barrels, and the like. The present disclosure provides an apparatus for use in the lifting of large and/or heavy objects that is readily configured to existing lifting equipment. The present disclosure also provides for an apparatus for use in the lifting of large and/or heavy objects that is inexpensive to manufacture, durable of construction, and reliable. These and other objects are realized by an apparatus for use in the lifting of large and/or heavy objects that includes an system comprising at least one engagement member, which when used with a second, oppositely facing engagement member, provides a system that allows a operator to engage an object, lift the object, relocate the object, lower the object, and disengage the object without getting out of the operator seat.

Thus, in a first embodiment, a lifting system is provided. The system comprising a pair of engagement members each independently configurable to an external equipment comprising at least a pair of elements movable in opposing horizontal directions and, independently or jointly, in a complementary vertical direction, a pair of oppositely facing structural members, each having a first end coupled to one of said pair of engagement members, and each one of said pair of structural members having a second end distally projecting from said corresponding first end. The pair of structural members moves correspondingly in an opposing horizontal direction and in a complementary vertical direction together with that of the equipment so as to engage, disengage, lift, lower, and optionally transport an object.

In a second embodiment, a lifting apparatus for use in the lifting of an object having an interior accessible via an opening is provided. The apparatus comprising an engagement member configured to secure to equipment having, independently or jointly, vertical and horizontal degrees of motion, a structural member having a first end coupled to the engagement member, and a second end distally projecting from the engagement member. The structural member comprises a surface configured to engage the interior of the object to provide at least one of a compressive resistance and a frictional resistance with the interior of the object in an amount capable of assisting the lift of the object.

In a third embodiment, a lifting apparatus for use in the lifting of an object having an interior accessible via an opening is provided. The apparatus comprising an engagement member configured to secure to equipment having, independently or jointly, vertical and horizontal degrees of motion, a structural member having a first end coupled to the engagement member, and a second end distally projecting from the engagement member. The structural member comprises a surface configured to engage the interior of the object to provide at least one of a compressive resistance and a frictional resistance with the interior of the object in an amount capable of assisting the lift of the object.

BRIEF DESCRIPTION OF THE DRAWINGS

The objects disclosed in the present disclosure and others will become more readily apparent with reference to the following description, and also when taken in conjunction with the enclosed drawings, in which.

DESCRIPTION

Figure 1:
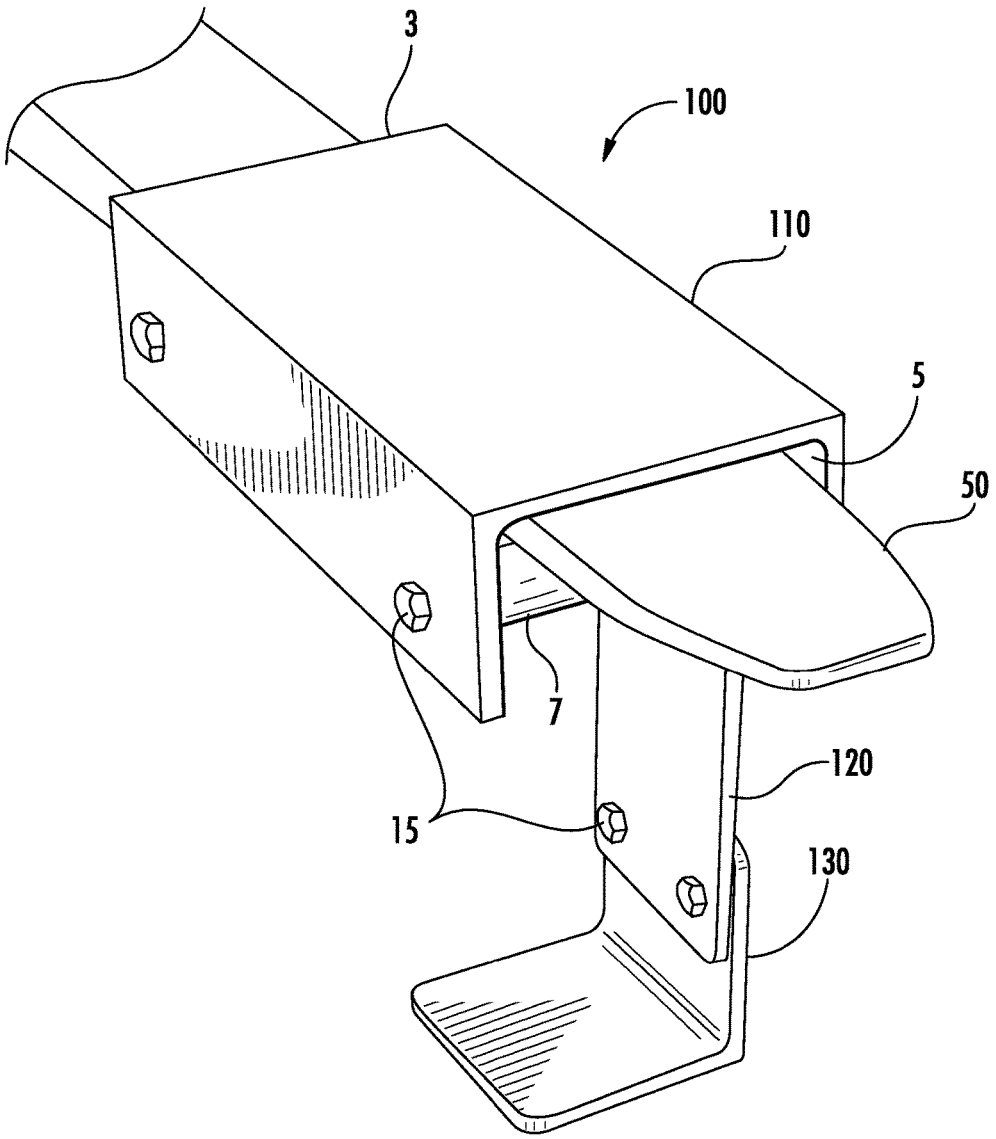
FIG. 1 is a perspective view of an embodiment of the apparatus as presently disclosed.

The present disclosure provides an apparatus and system to reduce and/or eliminate the safety and efficiency drawbacks of using just a forklift to lift, lower and/or relocate a heavy object and provide for the efficient and safe manipulation of such objects, such as an aerospace vehicle tire or the like, using equipment, such as a forklift.

While aspects of the present disclosure will be exemplified by reference to an aerospace vehicle tire, other objects, such as other large tires, barrels or containers, pipes, and bulk items can be lifted, lowered, and/or relocated using the apparatus and system of the present disclosure with minor modification to the apparatus to accommodate the object's shape and/or weight. In certain examples, specific reference is made to such objects.

Unless otherwise defined, all terms (including mechanical, technical, and scientific terms) used herein have the same meaning as commonly understood by one of ordinary skill in the art to which this present disclosure belongs. It will be further understood that terms used herein should be interpreted as having a meaning that is consistent with their meaning in the context of this specification and the relevant art and will not be interpreted in an idealized or overly formal sense unless expressly so defined herein.

It will be understood that, terms such as first, second, etc. may be used herein to describe various elements or configurations, these elements or configurations should not be limited by these terms. These terms are only used to distinguish one element or configuration from another, for example, a first element or configuration could be termed a second element or configuration, and, similarly, a second element or configuration could be termed a first element or configuration, without departing from the scope of the present disclosure. As used herein, the term "and/or" includes any and all combinations of one or more of the associated listed items.

Relative terms such as "below" or "above" or "upper" or "lower" or "horizontal" or "vertical" may be used herein to describe a relationship of one element to another element, or relative motion of elements, for example, as illustrated in the figures. It will be understood that these terms are intended to encompass different orientations and motion of the apparatus in addition to the orientation depicted in the figures and are not intended to limit the present disclosure in any way.

The terminology used herein is for the purpose of describing particular embodiments only and is not intended to be limiting in any way. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features steps, operations, elements, and/or components, but do not preclude the presence or addition of one or more other features, steps, operations, elements, components, and/or groups thereof.

Embodiments of the present disclosure will now be described more fully hereinafter with reference to the accompanying drawings, in which the embodiments are shown. This present disclosure may, however, be embodied in many different forms and should not be construed as limited to the embodiments set forth in the drawings. Rather, these embodiments are provided so that this disclosure will be thorough and complete, and will fully convey the scope of the invention to those skilled in the art. Like numbers refer to like elements throughout.

Referring now to the drawings, the presently disclosed apparatus is depicted generally by the numeral 100 in FIG. 1, wherein the apparatus 100 is shown attached to external equipment comprising at least a pair of elements 50 movable in opposing horizontal directions and, independently or jointly, in a complementary vertical direction, which in this figure and hereinafter, are depicted as forks of a forklift. While a forklift is hereinafter referenced, it is understood that other functionally equivalent equipment can be exchanged for the forklift as known in the art. The apparatus 100 includes a first embodiment of engagement member 110, also referred to herein as a "fork box" with the term "box" encompassing a box-like shape and other shapes, and thus not limiting the structure to any particular shape. Fork box 110 of FIG. 1 may be a substantially U-shaped plate that can be tapered, e.g., slightly larger at opening 3 than opposing opening 5 for interfering with equipment 50, such as a fork as shown. In addition, bolts 15 can secure support elements 7 for receiving/supporting fork of equipment 50. The fork box 110 is preferably designed and configured to withstand the weight of the objects that are intended to be lifted. The fork box 110 may be constructed of metal, such as steel or aluminum, alloys, engineering plastics, reinforced plastics, wood, or other suitable material. The fork box 110 can be formed from an elongated tube, i.e. an iron pipe, or comprise a shaped strip welded at one edge. The fork box 100 can be of a sleeve-like design for receiving equipment having, independently, vertical and horizontal degrees of motion, such as a pair of forks associated with a forklift or loader.

A structural member 120, secured to fork box 110 by welding, bolts, or other securing elements, projects generally downwardly from the fork box 110. In one aspect, structural element 120 projects essentially normal from the plane of the equipment element 50, or as shown, the fork. The structural member 120 is coupled to and projects from the fork box 110. The coupling can be by welding, bolts, pins, interference, and the like. The structural member 120 can be pivotally attached to the fork box 110 with a locked/un-locked configuration. The structural member 120 generally projects downwardly from the fork box 110. In a preferred aspect, the structural member 120 is rigidly coupled or in a locked configuration relative to the fork box 110, that being it is not free to swing or pivot about the fork box 110.

While the structural member 120 is shown with a generally straight edge, the member can be tensioned or bowed/arced to accommodate loading. The structural member 120 is preferably designed and configured to withstand the weight of the objects intended to be lifted. The structural member 120 can be constructed of one or more sections (or entirely) comprising metal, such as iron, steel, aluminum, or alloys, engineering plastics, reinforced plastics, wood, or other suitable material. In one aspect, the structural member 120 may be a metal. In another aspect, the structural member 120 may be substantially U-shaped with the relatively flat surface configured for presentation to an interior of the object to be lifted. Other shapes can be used such as I-beam, cylinder, rectangular prism, a flat plate, or a presenting shape having a curvature compatible with the interior of the object to be lifted.

In certain aspects, the presently disclosed apparatus can further comprise an isolation member 130, which can be attached to structural member 120. The optional isolation member 130, shown as an L-shaped plate, secured to structural member 120 by bolts 15. The isolation member 130 functions to assist in controlling and lifting the object and can assist, along with or independently of, the structural member 120 in lifting/manipulating and/or protecting the object from unwanted damage. In one aspect, optional isolation member 130 can be pivotally connected to the structural member 120 for collapsing the apparatus for storage/transport or when not needed for lifting.

Figure 2:
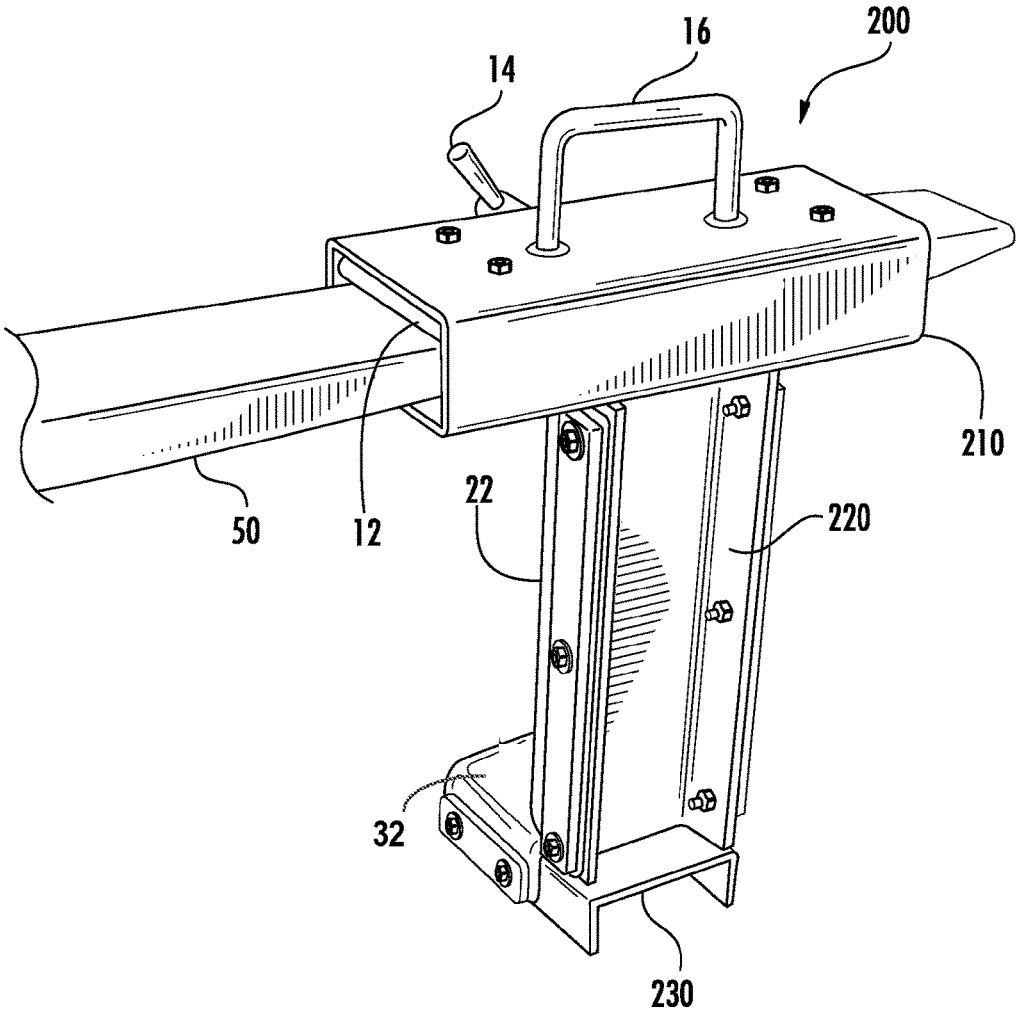
FIG. 2 is a side perspective view of another embodiment of the apparatus as presently disclosed.
Figure 3:
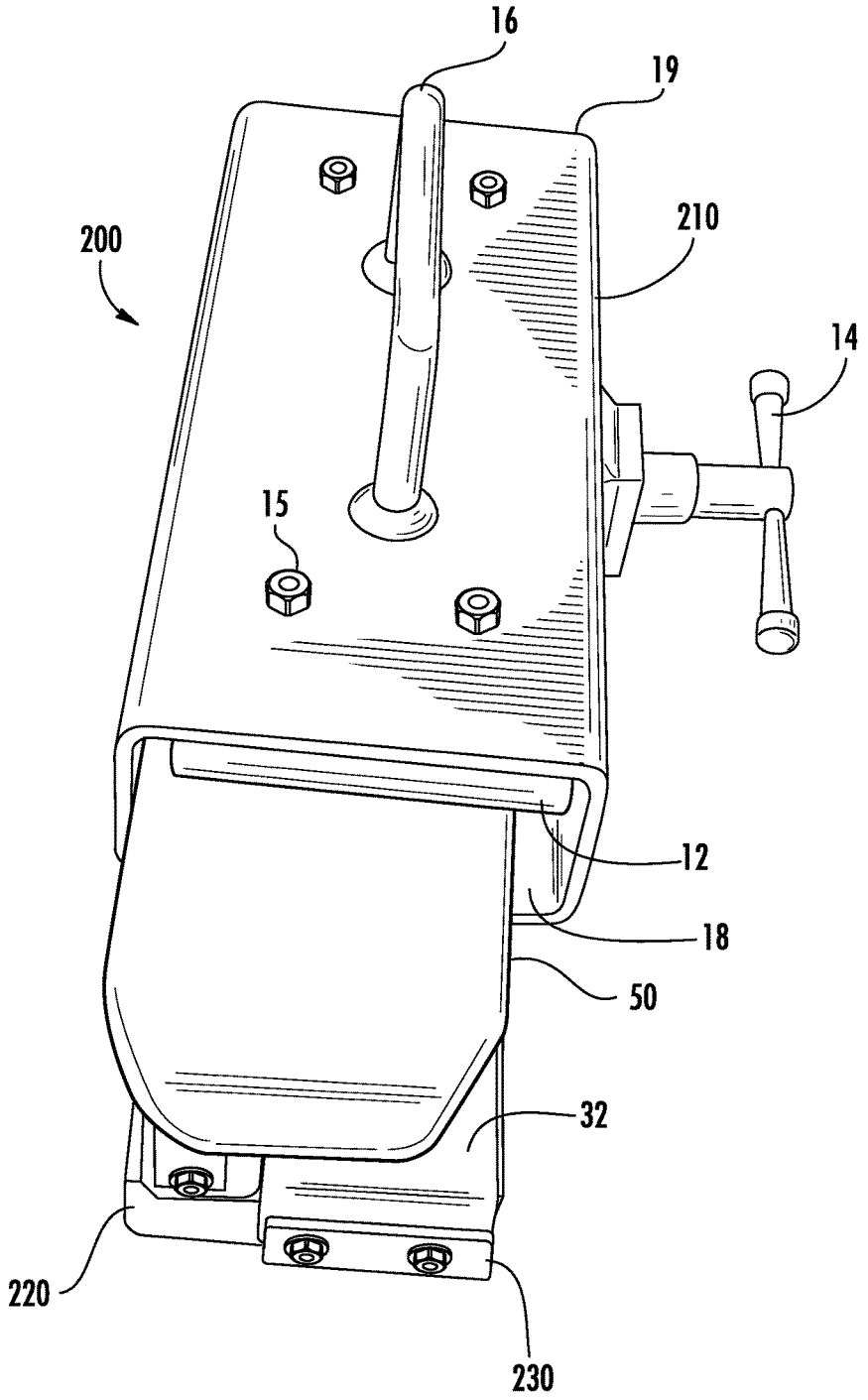
FIG. 3 is a top perspective view of the member of FIG. 2.

With reference to FIG. 2 and FIG. 3, another embodiment, apparatus 200 is depicted. Thus, the fork box 210 is of generally a box shaped configured with handle 16, at least one opening 19, optionally extending to an opposed opening 18 of smaller size (e.g., tapering from front to back through the fork box), to resistively secure to the fork 50 of the fork lift, e.g., by interference, and/or to fit a variety of sized forks. In other aspects, the fork box can be closed on one end, as a sleeve or sock, and can be tapered internally to secure the fork box by interference. Optionally, a handled set screw 14, which is threadably mounted in a tapped hole in the side or top of the fork box 210, can be employed to releasably secure the fork box 210 to equipment 50. Resistance element 12 positioned between equipment 50 and inner upper surface of fork box 210 is shown. In addition to the above securing mechanisms for fork box 210, or independent of these, various devices and mechanisms can be employed to secure the fork box to the equipment, such as a chain, set screw(s), bolts, pins, cams, and the like. In other aspects, the fork box 210 can be secured with a wedge positioned between the equipment and the inside of the fork box 210. In other aspects, the fork box 210 can be designed and used in an unsecured configuration. Structural member 220 can include padding or a surface member 22 for protecting the object to be lifted. In a preferred aspect, the structural member 220 is configured to engage the interior of the object to be lifted and comprises a separate or integrated surface comprised of at least one of a thermoplastic elastomer, a thermoset elastomer, a pressure sensitive adhesive, a natural or synthetic rubber, a plurality of asperities, and mixtures thereof. In one aspect, the surface of the structural member 220 is reversibly expandable to engage the interior of the object for assisting the lifting thereof. The surface can provide a compressive and/or frictional engagement with the object to secure and/or assist lifting or other manipulation of the object. In one aspect, the structural member 220 is of a metal construction and the surface is coated rubber or separate surface of at least one of a thermoplastic elastomer, a thermoset elastomer, a pressure sensitive adhesive, a natural or synthetic rubber, a plurality of asperities, and mixtures thereof. The separate surface can project away from the structural member in a radial manner so that the object to be lifted is not physically contacted by the structural member 220. The padding of surface 22 can be shaped, spaced, or grooved to receive one or both of the beads of a tire. Likewise, isolation member 230 can also include padding or a surface member 32.

Figure 4:
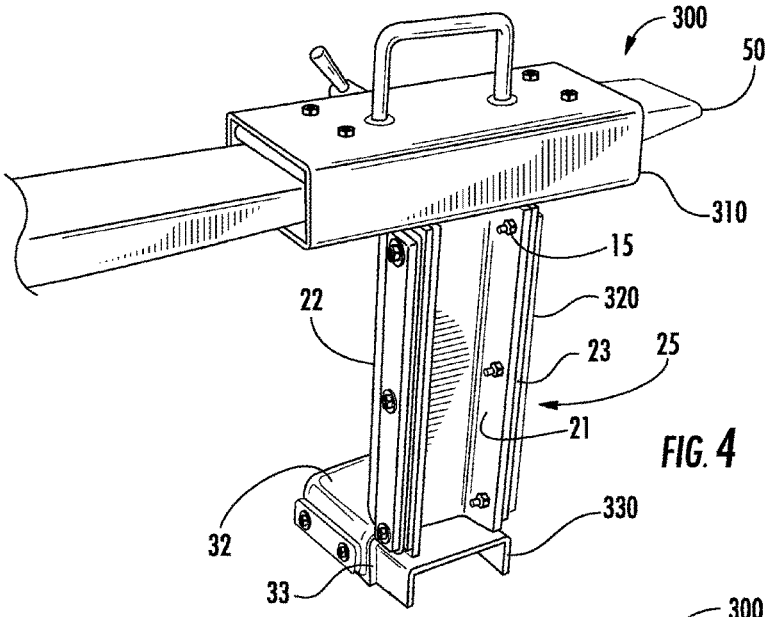
FIG. 4 is a side perspective view of another embodiment of the apparatus as presently disclosed, in a first configuration.
Figure 5:
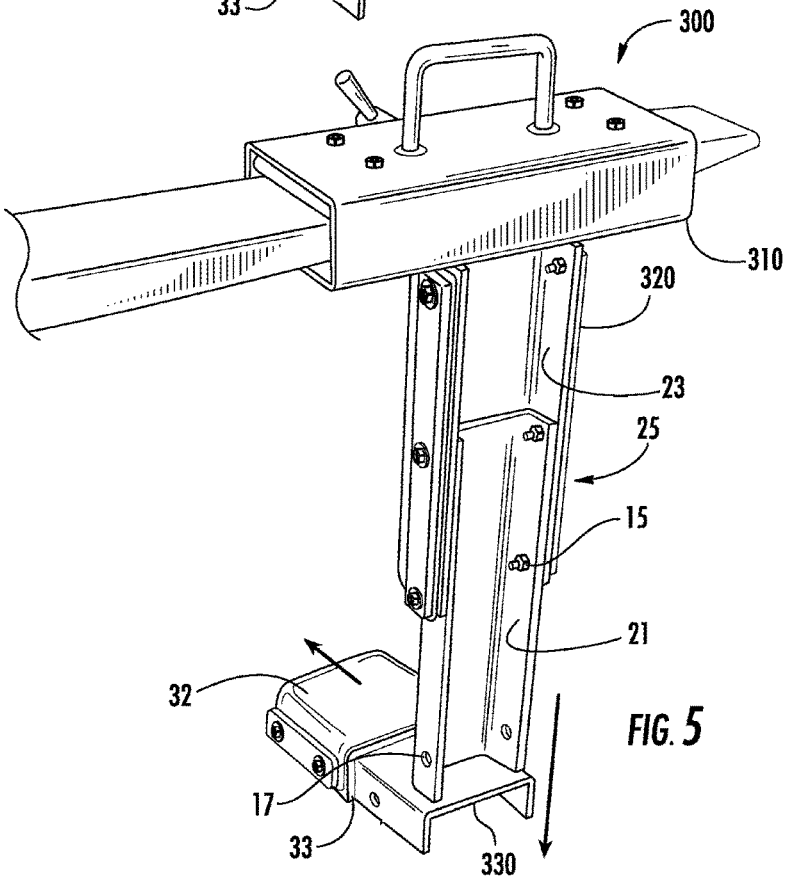
FIG. 5 a side perspective view of the embodiment of FIG. 4, in a second configuration.

With reference to FIG. 4 and FIG. 5, apparatus 300 is depicted, being similar in structure to the apparatus 200 but having telescoping members 25. Thus, the structural member 320 comprises telescopically configured elements 21, 23 to adjust in length of the structural member 320 for lifting differently sized objects, e.g., tires or multiple objects arranged in a stacked configuration. Mounted to the structural member element 21 and projecting generally normal thereto is an optional isolation member 330, comprising telescopically configured element 33 to adjust in length. The isolation member 330 and/or structural member 320 can be telescopically adjusted using bolts 15 which align with throughholes 17. Other telescoping arrangements of the elements can be used. The fork box 310 can also be configured in telescopic sections adjustable to vary its length, taper, or to provide additional structural strength. In other aspects, the fork box 310 can be of separate parts configured for assembly and securing about the equipment. In one aspect, one or more members of the system are configured to receive electrical and/or compressed fluid energy for providing power to the fork box 310, the structural member 320 or isolation member 310 for powering equipment or apparatus, such as magnets, hydraulics, lighting, inflatable structures, sensors, and other auxiliary equipment conventional to the equipment and operations generally used for lifting large and/or heavy objects. The telescopic sections may be adjustable to vary the length of the structural member. The telescopic sections of the structural member can be adjusted manually or by way of electrical power, compressed fluid, and/or hydraulic power. The telescopic sections of any of the structural member 320, isolation member 330, or the fork box 310 can be adjusted manually or by way of electrical power, compressed fluid, and/or hydraulic power.

Figure 6:
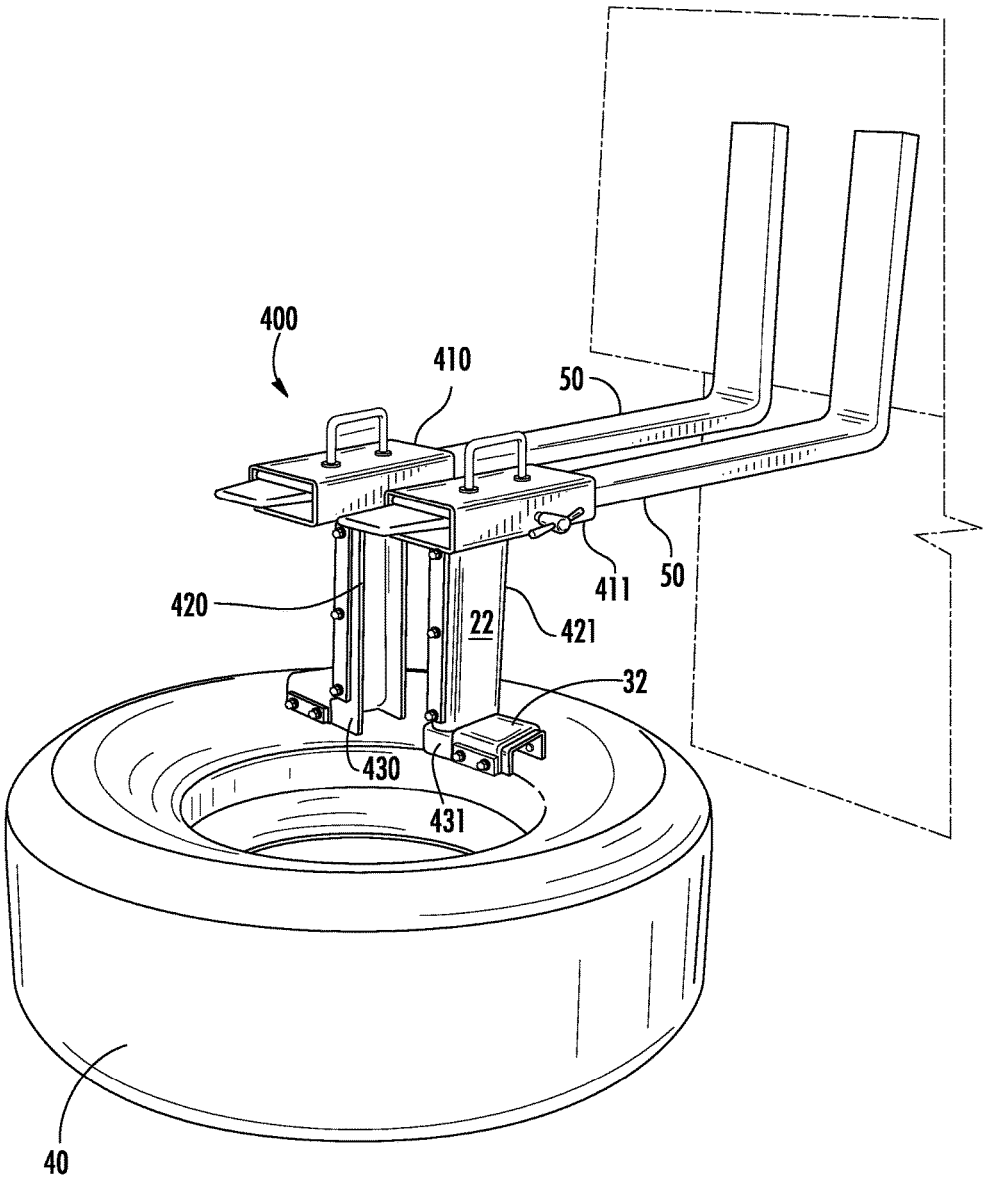
FIG. 6 is a perspective view of the system as presently disclosed, in a first operational configuration.

With reference to FIG. 6, in accordance with the present disclosure, a lifting system 400 is provided. The system 400 comprises a pair of engagement members 410, 411 (hereafter "fork boxes"), each independently configurable to equipment comprising at least a pair of elements 50 that may be movable in opposing horizontal directions and in a complementary vertical direction. The system 400 comprises a pair of oppositely facing structural members 420, 421 each coupled to the corresponding pair of fork boxes 410, 411, respectively, and each one of the pair of structural members 420, 421 distally projecting from its corresponding engagement member presenting in one sense, an L-like configuration. The system 400 provides for the pair of structural members 420, 421 to move in an opposing horizontal direction and also, independently or jointly, in a complementary vertical direction so as to engage, disengage, lift, lower, and optionally transport an object 40, such as a tire. Optionally, a pair of isolation members 430, 431, configured to oppositely project from the distal end of the structural members 420, 421, respectively, for assisting the system 400 in engaging, disengaging, lifting, lowering, and optionally transporting an object. The members individually or collectively can be configured telescopingly to adjust their length. In one aspect, the isolation members 430, 431 may include the same or different surface or surface characteristics as the structural members 420, 421, discussed above.

Using the presently disclosed apparatus and system, the operation of the apparatus is now described with reference to FIGS. 6-10. Thus, an aspect of the method of lifting a tire object is shown. FIG. 6 shows the lifting system 400, shown in a first operational configuration positioned vertically above an opening of the object, comprising a pair of engagement members 410, 411 having an opening therein. Each of the pair of engagement members 410, 411 may receive in their respective openings, a pair of forks 50 of a forklift (not shown). The pair of forks may be movable in opposing horizontal directions and in a complementary vertical direction. Each of the pair of engagement members 410, 411 may further comprise a pair of oppositely facing structural members 420, 421, each coupled to one of the pair of engagement members 410, 411, respectively. Each one of the pair of structural members 420, 421 may distally project from its corresponding engagement member 410, 411. Optionally, isolation members 430, 431 associated with the distal end of the structural members 420, 421, respectively, can be employed. The method comprises, positioning the pair of oppositely facing structural members 420, 421 in vertical proximity to an opening in an object 40 to be lifted, for example the opening of a tire object defined by upper and lower inner beads 41,42, respectively.

Figure 7:
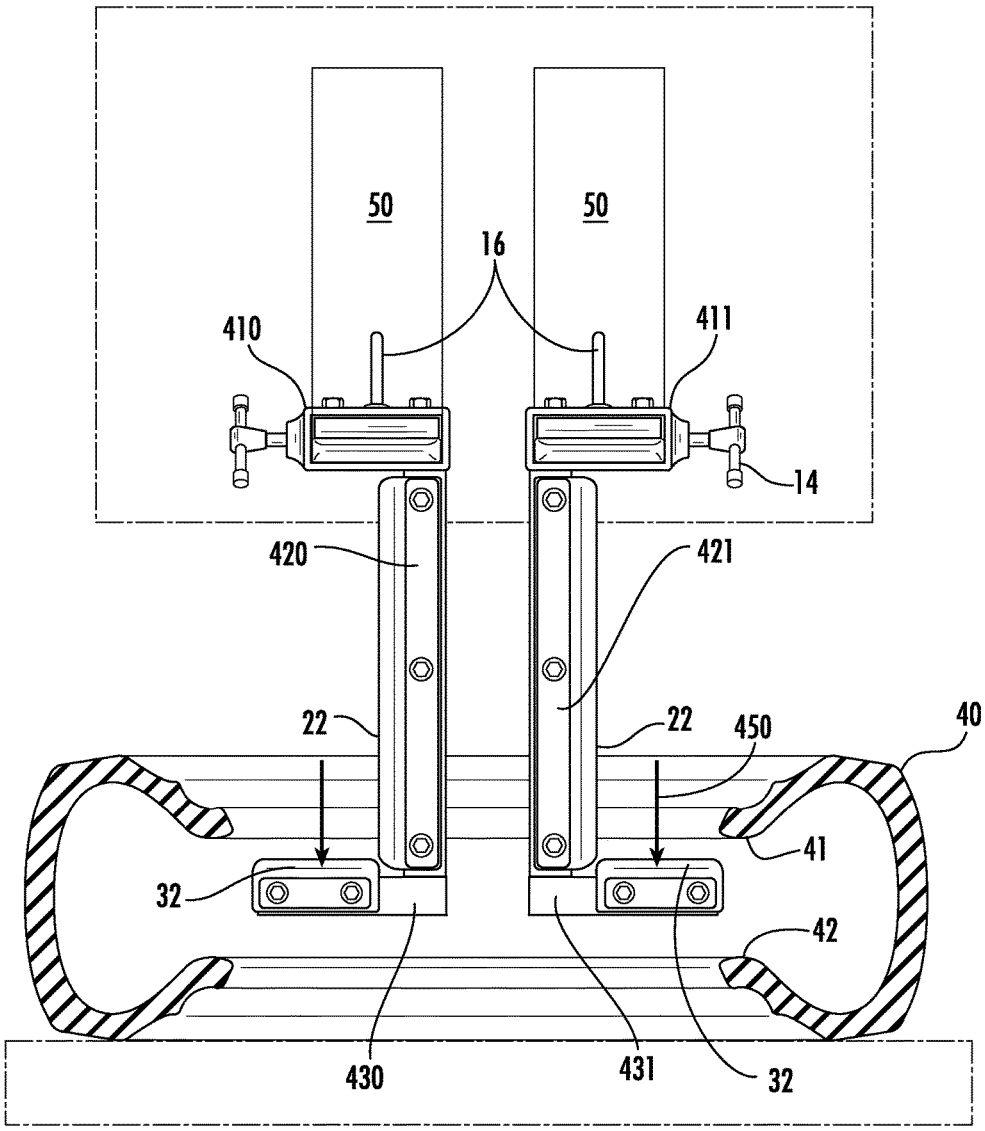
FIG. 7 is a front plan view of the system of FIG. 6, in a second operation configuration, with a sectional view of a tire object.

Referring to FIG. 7, the system 400 is shown in a second operational configuration. The pair of oppositely facing structural members 420, 421 are positioned so that at least a portion of the pair of oppositely facing structural members 420, 421 extend into the opening of the object 40 as shown by arrow 450.

Figure 8:
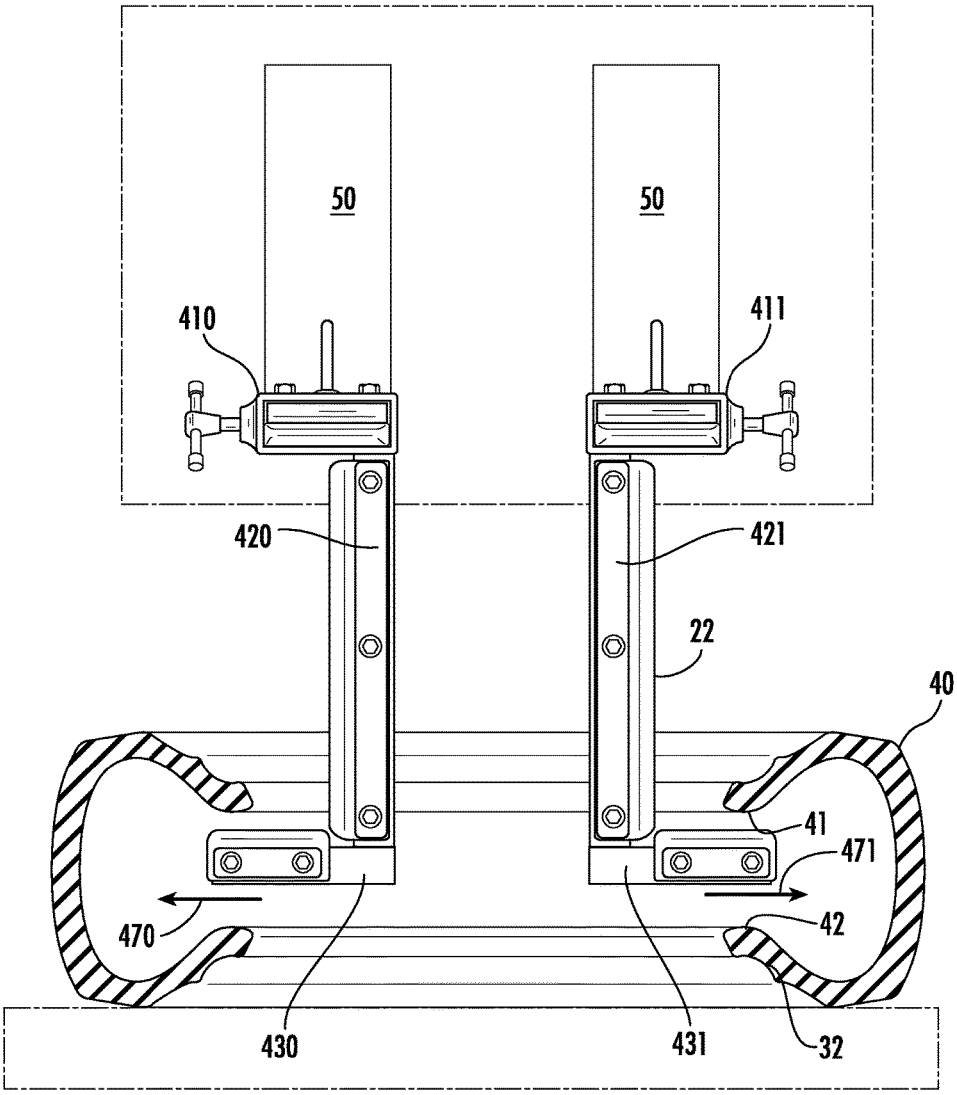
FIG. 8 is a front plan view of the system of FIG. 6 in a third operational configuration.
Figure 9:
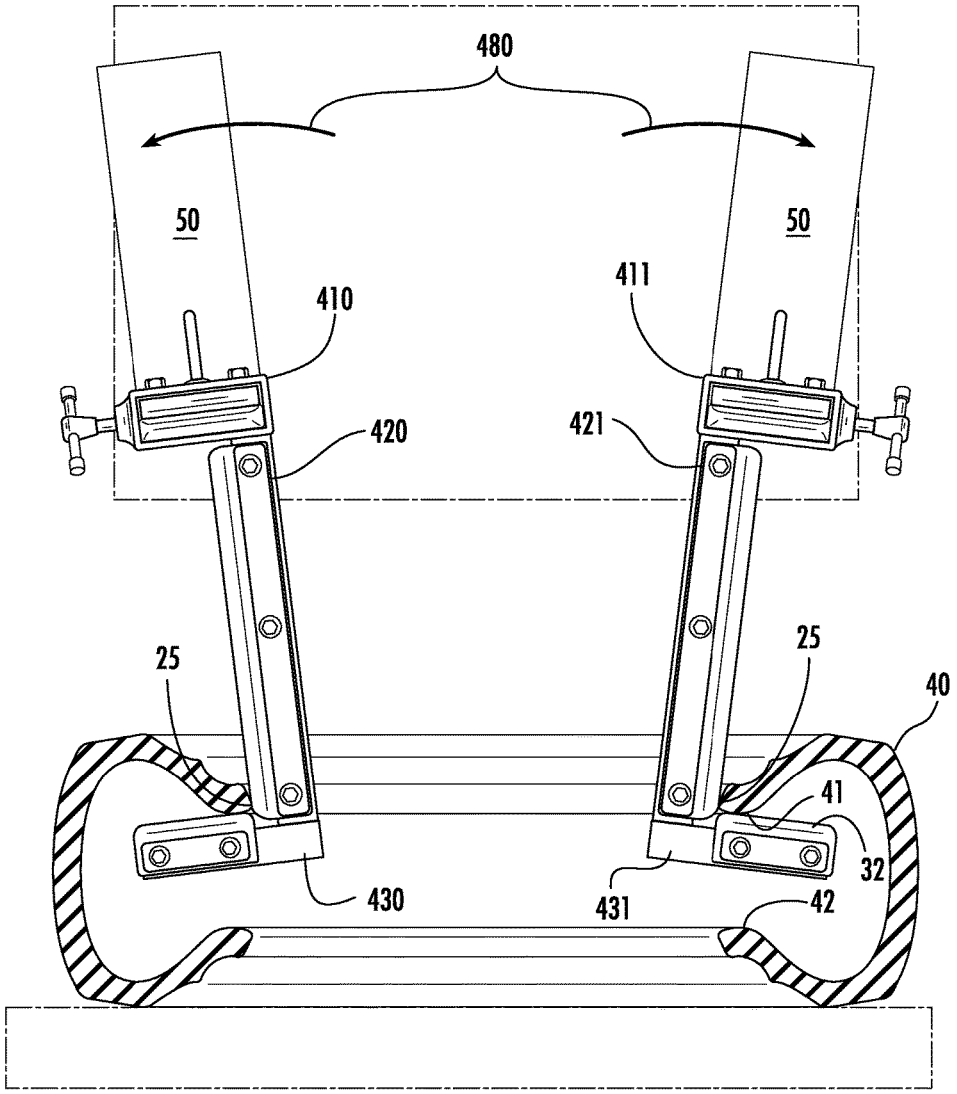
FIG. 9 is a front plan view of the system of FIG. 6 in a fourth operational configuration.

Referring to FIGS. 8-9, the system 400 is shown in a third and fourth operational configurations, respectively. The pair of oppositely facing structural members 420, 421 are moved in opposing horizontal directions as shown by arrows 470, 471, respectively, corresponding to equipment movement 480, 481. The equipment movement 480 can include a slight arc motion from torque, wherein the structural members 420, 421 and optional isolation members 430, 431, engage the inner bead 41 of the object 40 at contact point 25. Alternatively, the isolation members 430, 431 can be positioned under the lower bead 42 of the tire 40.

Figure 10:
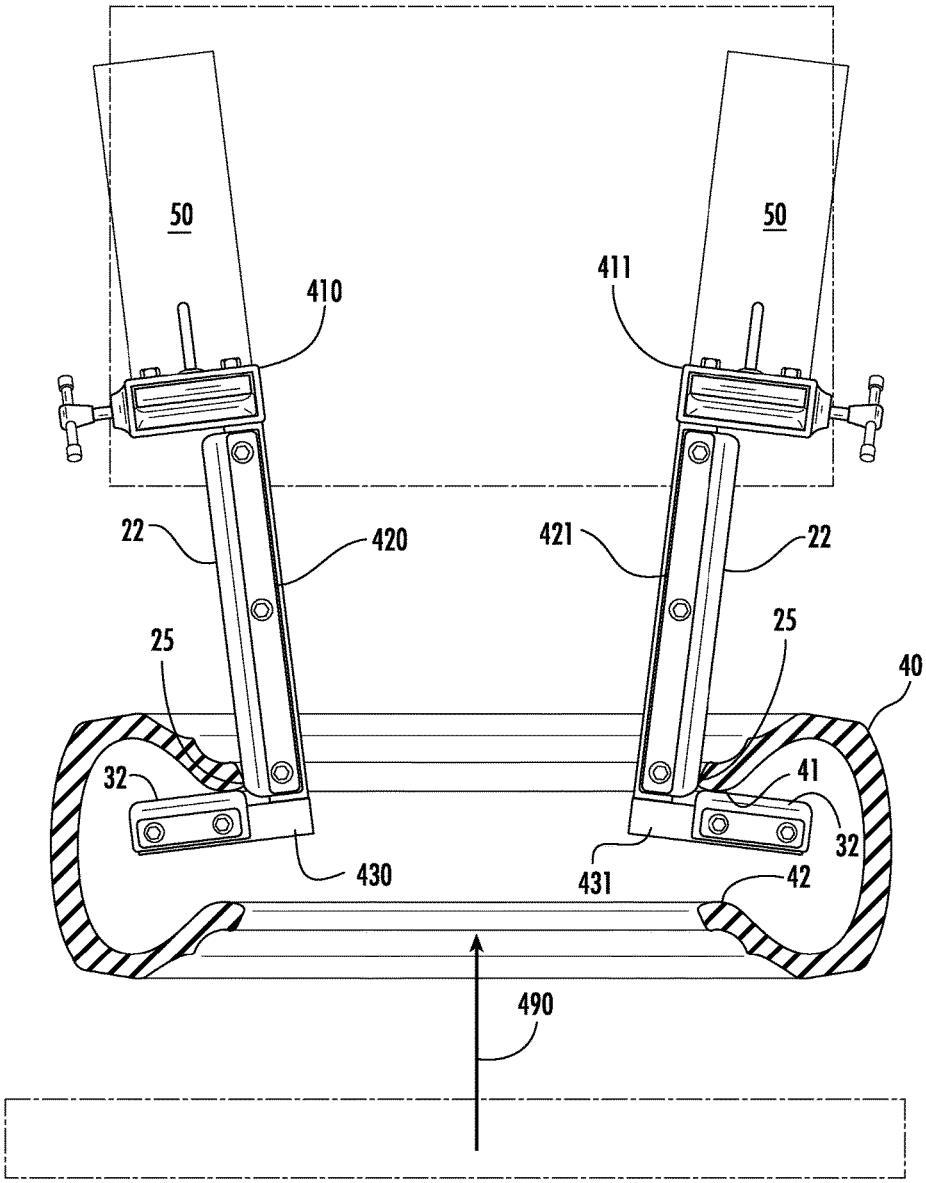
FIG. 10 is a front plan view of the system of FIG. 6 in a fifth operational configuration.

With reference to FIG. 10, the system 400 is shown in a fifth operational configuration. The system 400 is engaged to lift the object 40. The pair of oppositely facing structural members 420, 421 are complementarily moved in a vertical direction upward as shown by arrow 490. Thus, the operator need not leave the equipment, and possibly eliminating the need for additional persons to be present and/or involved in the operation. Optional surface elements 22, 32, as described above, can be employed on one or both of the structural member and/or isolation member, to protect the inner bead (s) of the tire from incidental damage.

In certain aspects, one or more objects, e.g., tires can be stacked in a horizontal orientation and the presently disclosed system can be employed to lift one or more of the stacked tires by positioning the pair of oppositely facing structural members through one or more of the tire openings such that the optional isolation member can engage the upper inner bead of the tire at the bottom of the stack (or the bottom tire of the stack to be lifted).

Figure 11:
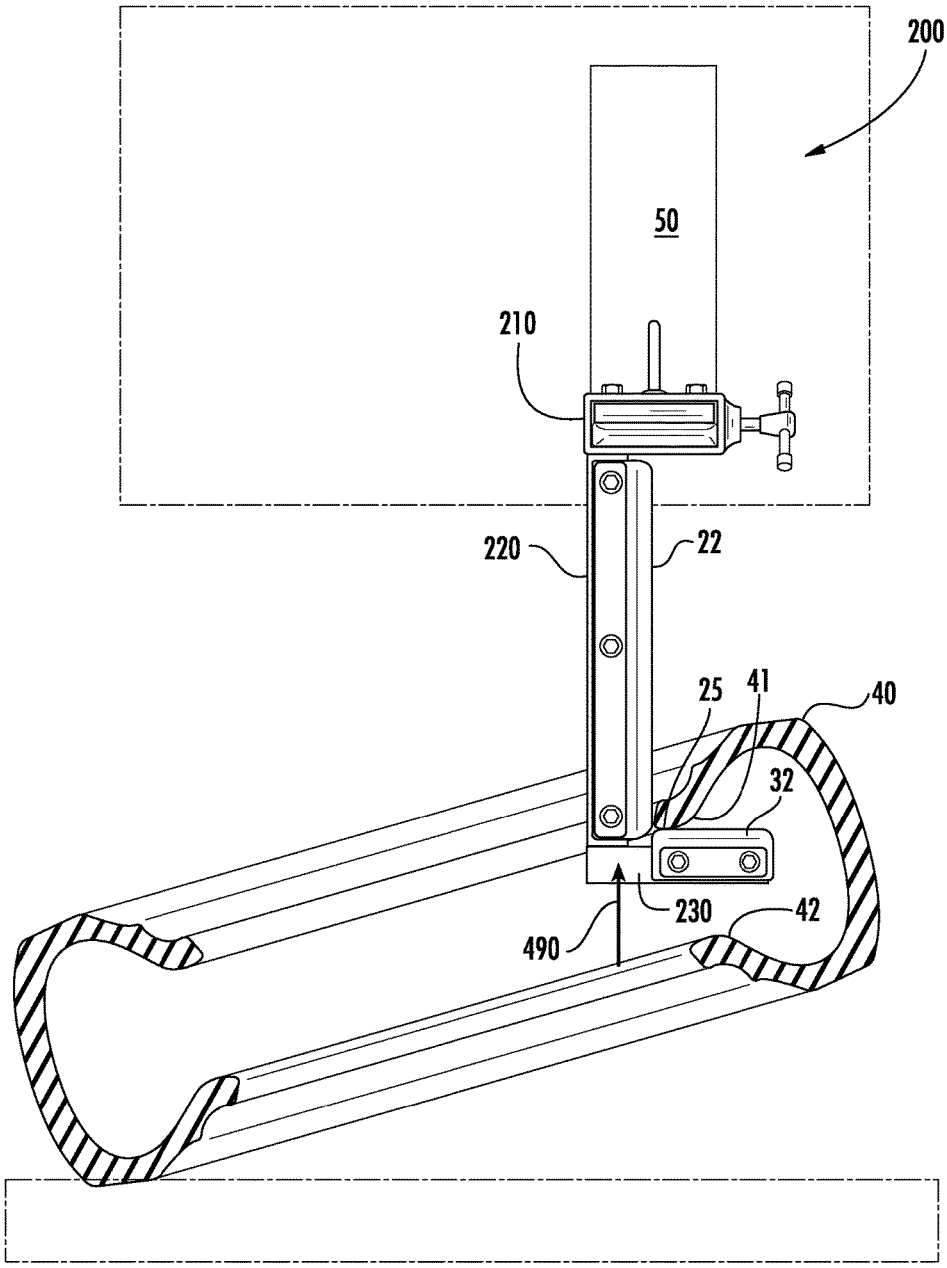
FIG. 11 is a front plan view of an alternate system presently disclosed in an operational configuration, with a sectional view of a tire object.

Referring to FIG. 11, it is possible to provide vertical displacement of an object using a single lifting apparatus 200, as shown, (or apparatus 100 similar to that shown in FIG. 1) attached to equipment as discussed above. The structural member 220 and isolation member 230 may engage upper bead 41 at contact point 25, e.g., hooking or catching the interior of object 40, and angularly displacing one side of the object relative to the other. Alternatively, the isolation member 230 can be positioned under the lower bead 42 of the tire 40.

Figure 12:
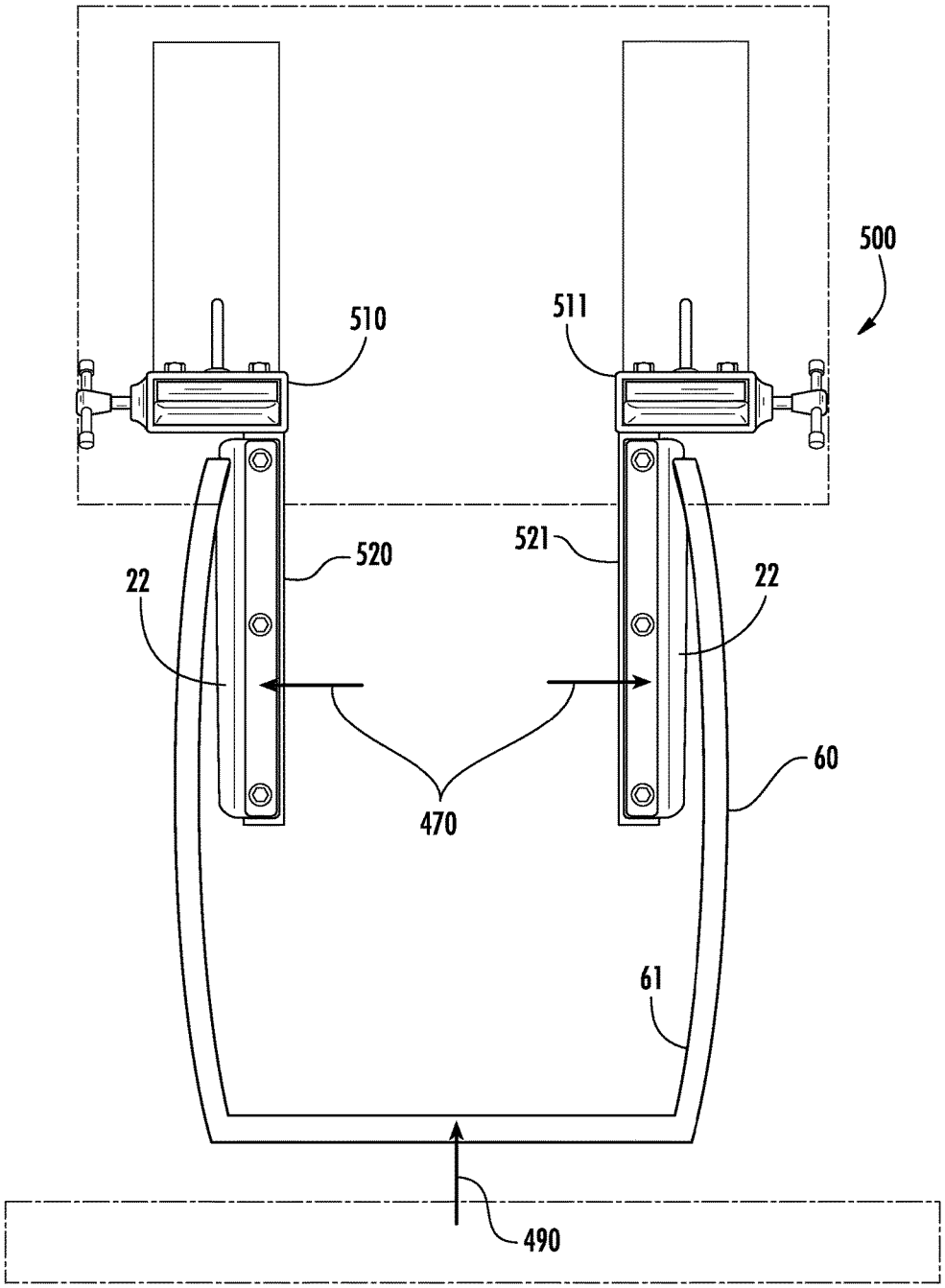
FIG. 12 is a perspective view of an alternate system as presently disclosed in an operational configuration and a sectional view of a barrel/pipe object.

With reference to FIG. 12, using suitably equipped forklifts or loaders, system 500, comprising fork boxes 510, 511 with coupled structural members 520, 521, respectively (shown without isolation members). The structural members 520, 521 may provide for engagement (arrows 470), lifting (arrow 490), and disengagement of objects having openings with a longitudinal axis (such as a barrel or pipe-like structure 60). Objects may be lifted either normal to the floor, or 180 degrees relative to the floor and any angle therebetween. In addition, the system and apparatus presently disclosed provides for altering the longitudinal axis of the object from its current orientation. Thus, for example, a tire can be reoriented from a horizontally disposed state to vertical state (and visa versa), or a barrel can be emptied of its contents, or a section of piping/tubing can be re-oriented 180 degrees for joining or storage. Surface 22 can be as described above, and (i) can be configured to be inflatable, for example, by compressed air, or (ii) can be configured to draw vacuum to secure to inside surface 61 of barrel/pipe for assisted lifting.

The above has been described both generically and with regard to specific embodiments. Although the present disclosure has been set forth in what is believed to be the preferred embodiments, a wide variety of alternatives known to those of skill in the art can be selected within the generic disclosure. Other advantages and obvious modifications of the present disclosure will be apparent to the artisan from the above description and further through practice of the present disclosure.

I claim:

1. A lifting system for use in the lifting of a tire having an accessible interior, the lifting system comprising:

one elongated sleeve or two isolated and unconnected elongated sleeves, each elongated sleeve consisting of a longitudinal axis with opposing openings configurable to reversibly receive and engage a fork of a forklift through the opposing openings; and a rigid structural member consisting of a first end coupled to the sleeve, terminating at a second end distally projecting vertically downward normal to the longitudinal axis of the elongated sleeve from said corresponding first end; and a single linear isolation member coupled to the second end, the isolation member extending horizontally from the second end and projecting substantially perpendicular to the longitudinal axis of the elongated sleeve, the isolation member having: a thickness less than a separation distance of an upper and a lower inner bead of the tire; a length and a width less than the diameter of the tire; and a surface configured to engage a bead of the accessible interior of the tire and capable of assisting the lifting of the tire.

2. The lifting system of claim 1, wherein the structural member comprises a telescoping element configured to adjust the distance between the first end and the second end thereof.

3. The lifting system of claim 1, wherein at least a portion of the structural member and/or at least a portion of the isolation member comprises at least one of a thermoplastic elastomer surface, a thermoset elastomer surface, a pressure sensitive adhesive surface, a natural or synthetic rubber surface, a surface of a plurality of asperities, and mixtures thereof.

4. The lifting system of claim 3, wherein the at least a portion of the structural member and/or at least a portion of the isolation member provides at least one of a compressive resistance and a frictional resistance with the bead of the tire capable of assisting the lift of the tire.

5. The lifting system of claim 1, wherein the isolation member is shaped, spaced or contains grooves to engage a bead of the accessible interior of the aircraft tire.

6. A method of lifting a tire having an interior accessible via an opening, the method comprising:

(i) providing a pair of elongated sleeves each with a longitudinal axis, each with opposing openings, each reversibly receiving forks of a forklift through the opposed openings, each isolated and unconnected from each other, wherein each of the forks are movable in opposing horizontal directions to that of each of the longitudinal axes, each of the elongated sleeves consisting of an oppositely facing rigid structural member, each of the structural members having a first end coupled to its respective elongated sleeve, and each one of the structural members terminating at a second end distally projecting vertically downward and normal to the longitudinal axis of the elongated sleeve from the first end, each structural member consisting of a projecting linear isolation member coupled to the second end and extending substantially perpendicularly from the structural member and projecting substantially perpendicular to the longitudinal axis of the corresponding elongated sleeve; the isolation members having: a thickness less than a separation distance of an upper and a lower inner bead of a tire; and a length and width less than the diameter of the tire, a surface configured to engage a bead of the accessible interior of the tire and capable of assisting the lifting of the tire, and wherein the projecting isolation members project oppositely from each other;

(ii) positioning at least a portion of the isolation member into the accessible opening of the tire;

(iii) moving the forks of the forklift away from each other in opposing horizontal directions until a portion of the isolation member is positioned to engage a bead of the tire from within the interior of the tire;

(iv) moving the forks of the forklift vertically and engaging the isolation member with a bead of the tire; and (v) lifting the tire.

7. The method of claim 6, wherein each isolation member comprises a telescoping element configured to adjust the projecting distance thereof.

8. The method of claim 6, wherein the tire is an aerospace vehicle tire.

9. A lifting system comprising a forklift having a pair of forks separable in an opposing horizontal direction; and one fork box or two isolated and unconnected fork boxes, each of the one or two fork boxes having a longitudinal axis and consisting of:

a longitudinal axis;

opposing openings sized to reversibly receive one of the forks;

a securing mechanism configured for applying or removing a securing force between either one of the pair of forks and the fork box;

a rigid structural member having a first end rigidly coupled to the fork box, terminating at a second end distally projecting downward normal to the longitudinal axis of the fork box from the first end; and a single linear isolation member coupled to the second end, the isolation member extending substantially perpendicular from the structural member and projecting substantially perpendicular to the longitudinal axis of the fork box, the isolation member having: a thickness less than a separation distance of an upper and a lower inner bead of a tire; a length and a width less than the diameter of the tire; and a surface configured to engage an accessible interior of a tire.

10. The lifting system of claim 9, wherein each of the forks have a fork box attached thereto.

11. The lifting system of claim 9, wherein the isolation member is shaped, spaced or contains grooves to engage the bead of the accessible interior of the tire.

* * * * *